US010633729B2

(12) United States Patent
Ueda et al.

(10) Patent No.: US 10,633,729 B2
(45) Date of Patent: Apr. 28, 2020

(54) AUSTENITIC HEAT-RESISTING CAST STEEL

(71) Applicants: TOYOTA JIDOSHA KABUSHIKI KAISHA, Toyota-shi, Aichi (JP); KABUSHIKI KAISHA TOYOTA CHUO KENKYUSHO, Nagakute-shi, Aichi (JP)

(72) Inventors: Takamichi Ueda, Toyota (JP); Harumi Ueno, Toyota (JP); Takumi Hijii, Tajimi (JP); Hitomi Hirai, Nagoya (JP); Takashi Maeshima, Nagakute (JP); Kazuaki Nishino, Nagakute (JP); Hirofumi Ito, Nagakute (JP)

(73) Assignees: TOYOTA JIDOSHA KABUSHIKI KAISHA, Toyota-shi, Aichi (JP); KABUSHIKI KAISHA TOYOTA CHUO KENKYUSHO, Nagakute-shi, Aichi (JP)

( * ) Notice: Subject to any disclaimer, the term of this patent is extended or adjusted under 35 U.S.C. 154(b) by 197 days.

(21) Appl. No.: 15/575,423

(22) PCT Filed: Jun. 2, 2016

(86) PCT No.: PCT/JP2016/066429
§ 371 (c)(1),
(2) Date: Nov. 20, 2017

(87) PCT Pub. No.: WO2016/195023
PCT Pub. Date: Dec. 8, 2016

(65) Prior Publication Data

US 2018/0155809 A1 Jun. 7, 2018

(30) Foreign Application Priority Data

Jun. 4, 2015 (JP) ..... 2015-113607

(51) Int. Cl.
*C22C 38/08* (2006.01)
*C22C 38/12* (2006.01)
(Continued)

(52) U.S. Cl.
CPC ..... *C22C 38/50* (2013.01); *C22C 38/00* (2013.01); *C22C 38/001* (2013.01);
(Continued)

(58) Field of Classification Search
CPC ..... C22C 38/00; C22C 38/001; C22C 38/002; C22C 38/005; C22C 38/02; C22C 38/04;
(Continued)

(56) References Cited

U.S. PATENT DOCUMENTS 6,383,310 B1 * 5/2002 Otsuka ..... C22C 38/40 148/327
7,297,214 B2 * 11/2007 Ishida ..... C22C 19/055 148/310
(Continued)

FOREIGN PATENT DOCUMENTS

JP S5773171 A 5/1982
JP 4379753 B2 12/2009
(Continued)

OTHER PUBLICATIONS

International Search Report for PCT/JP2016/066429 dated Aug. 30, 2016 [PCT/ISA/210].

*Primary Examiner* — Coleen P Dunn
*Assistant Examiner* — Anthony M Liang
(74) *Attorney, Agent, or Firm* — Sughrue Mion, PLLC

(57) ABSTRACT

Provided is austenitic heat-resisting cast steel that is excellent in both of the heat resistance and the machinability. Austenitic heat-resisting cast steel, includes: C: 0.1 to 0.4 mass %; Si: 0.8 to 2.5 mass %; Mn: 0.8 to 2.0 mass %; S: 0.05 to 0.30 mass %; Ni: 5 to 20 mass %; N: 0.3 mass % or
(Continued)

less; Zr: 0.01 to 0.20 mass %; Ce: 0.01 to 0.10 mass %; one type or more of the elements selected from the following groups of (i) to (iii), at least including (i), (i) Cr: 14 to 24 mass %, (ii) Nb: 1.5 mass % or less, and (iii) Mo: 3.0 mass % or less; and Fe and inevitable impurity as a remainder.

9 Claims, 6 Drawing Sheets

(51) Int. Cl.

| | |
|---|---|
| ***C22C 38/18*** | (2006.01) |
| ***C22C 38/40*** | (2006.01) |
| ***C22C 38/50*** | (2006.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/44* (2013.01); *C22C 38/48* (2013.01); *C22C 38/60* (2013.01)

(58) Field of Classification Search
CPC ..... C22C 38/08; C22C 38/12; C22C 38/14; C22C 38/18; C22C 38/26; C22C 38/28; C22C 38/34; C22C 38/38; C22C 38/40; C22C 38/44; C22C 38/48; C22C 38/50; C22C 38/58; C22C 38/60
See application file for complete search history.

(56) References Cited

U.S. PATENT DOCUMENTS

| | | | | |
|---|---|---|---|---|
| 7,381,369 | B2 * | 6/2008 | Ishida | C22C 19/055 148/121 |
| 2007/0034302 | A1 * | 2/2007 | Takahashi | B01J 19/02 148/327 |
| 2008/0279716 | A1 * | 11/2008 | Nishiyama | B21K 1/063 420/452 |
| 2010/0034690 | A1 * | 2/2010 | Nishiyama | C22C 38/02 420/49 |
| 2014/0127073 | A1 * | 5/2014 | Nishiyama | C22C 30/02 420/36 |
| 2014/0356641 | A1 * | 12/2014 | Miyamura | C22C 38/001 428/544 |
| 2016/0068936 | A1 * | 3/2016 | Ohtake | C21D 6/004 148/542 |

FOREIGN PATENT DOCUMENTS

| | | | |
|---|---|---|---|
| JP | 4504736 | B2 | 7/2010 |
| JP | 4632954 | B2 | 2/2011 |
| JP | 2014208875 | A | 11/2014 |

* cited by examiner

AUSTENITIC HEAT-RESISTING CAST STEEL

CROSS REFERENCE TO RELATED APPLICATIONS

This application is a National Stage of International Application No. PCT/JP2016/066429 filed Jun. 2, 2016, claiming priority based on Japanese Patent Application No. 2015-113607 filed Jun. 4, 2015, the contents of all of which are incorporated herein by reference in their entirety.

TECHNICAL FIELD

The present invention relates to austenitic heat-resisting cast steel, and particularly relates to austenitic heat-resisting cast steel that has excellent machinability and heat resistance.

BACKGROUND ART

Conventionally austenitic heat-resisting cast steel has been used for the components of an exhaust system in an automobile, such as an exhaust manifold and a turbine housing. Such components are used in severe environment at high temperatures. For excellent thermal fatigue resistance, they are required to have excellent high-temperature strength and such toughness from room temperatures to high temperatures.

In this respect, Patent Literature 1, for example, proposes austenitic heat-resisting cast steel containing 0.2 to 0.6 mass % of C, 0.1 to 2 mass % of Si 0.1 to 2 mass % of Mn, 0.05 to 0.2 mass % of 5, 0.05 mass % or less of Se, 10.0 to 45.0 mass % of Ni, 15.0 to 30.0 mass % of Cr, 8.0 mass % or less of W, and 3.0 mass % or less of Nb, and iron and inevitable impurity as a remainder, and includes an austenite phase mainly containing Fe—Ni—Cr as the parent phase.

For better heat resistance, this austenitic heat-resisting cast steel includes C, Ni, Cr, W, and Nb added. For better machinability, this heat-resisting cast steel includes Mn and S to generate free-cutting particles of MnS. This heat-resisting cast steel includes a free-cutting element Se added for much better machinability.

CITATION LIST

Patent Literature

Patent Literature 1: JP 4504736 B

SUMMARY OF INVENTION

Technical Problem

As described above, the austenitic heat-resisting cast steel described in Patent Literature 1 includes C, Ni, Cr, W, and Nb added for better heat resistance, so that hard particles including carbide, such as $Cr_7C_3$, are generated.

Such hard particles, however, are generated in the soft austenite structure, and the cutting of the austenite structure will be intermittent during cutting of this heat-resisting cast steel, for example. As a result, the cutting tool used may be worn considerably. To avoid wear, the austenitic heat-resisting cast steel described in Patent Literature 1 includes free-cutting elements, such as Mn, S and Se, added. However, when hard particles of a certain amount exist, the effect of the free-cutting elements will be limited because of great influences of the intermittent cutting as stated above.

In view of these points, the present invention aims to provide austenitic heat-resisting cast steel that is excellent in both of the heat resistance and the machinability.

Solution to Problem

Austenitic heat-resisting cast steel according to the present invention, includes: C: 0.1 to 0.4 mass %; Si: 0.8 to 2.5 mass %; Mn: 0.8 to 2.0 mass %; S: 0.05 to 0.30 mass %; Ni; 5 to 20 mass %; N: 0.3 mass % or less; Zr; 0.01 to 0.20 mass %; Ce: 0.01 to 0.10 mass %; one type or more of the elements selected from the following groups of (i) to (iii), at least including (i), (i) Cr: 14 to 24 mass %, (ii) Nb: 1.5 mass % or less, and (iii) Mo: 3.0 mass % or less; and Fe and inevitable impurity as a remainder.

The austenitic heat-resisting cast steel according to the present invention includes the elements in the range as stated above, and so is excellent in both of the heat resistance and the machinability. The reasons for specifying the range of these elements are described in the following embodiments.

In a preferable aspect, the austenitic heat-resisting cast steel includes the (ii) in addition to the (i). The austenitic heat-resisting cast steel of this aspect includes Nb in the range of Nb: 1.5 mass % or less, and so can have improved creep strength of the heat-resistance characteristics.

Advantageous Effects of Invention

The austenitic heat-resisting cast steel according to the present invention is excellent in both of the heat resistance and the machinability.

DESCRIPTION OF EMBODIMENTS

Figure 1:
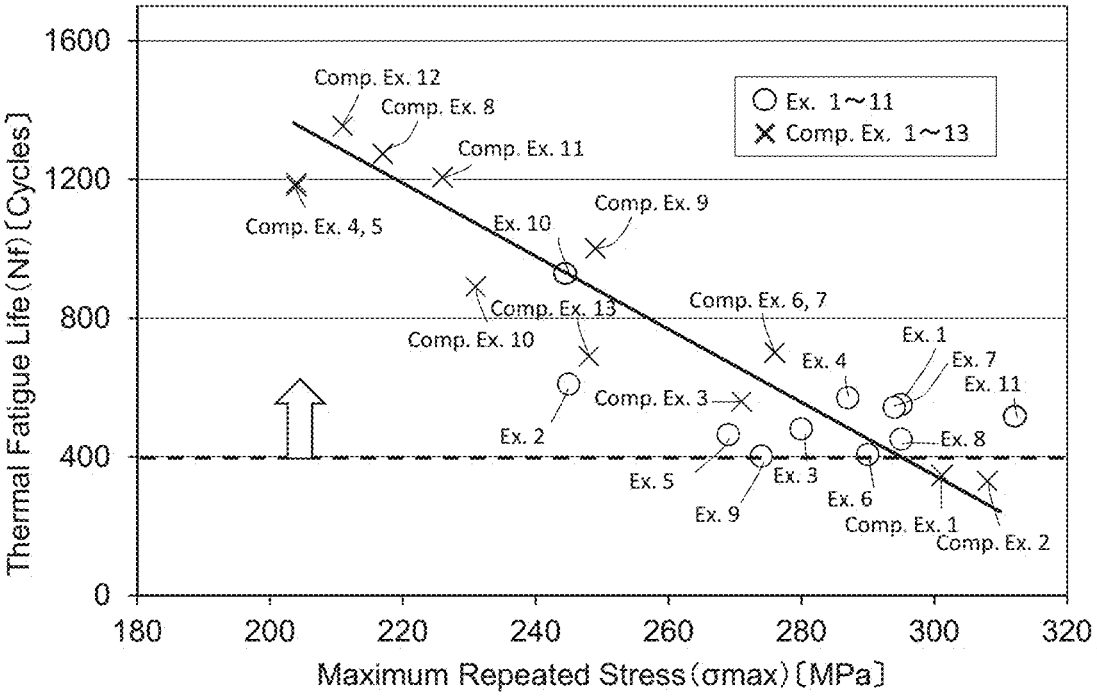
FIG. 1 shows the relationship between the maximum value of the repeated stress and the thermal fatigue life of the austenitic heat-resisting cast steel according to Examples 1 to 11 and Comparative Examples 1 to 13.

The following describes austenitic heat-resisting cast steel according to one embodiment of the present invention.

Austenitic heat-resisting cast steel according to the present embodiment, includes: C: 0.1 to 0.4 mass %; Si: 0.8 to 2.5 mass %, Mn: 0.8 to 2.0 mass %, S: 0.05 to 0.30 mass %; Ni: 5 to 20 mass %; N: 0.3 mass % or less; Zr: 0.01 to 0.20 mass %; Ce: 0.01 to 0.10 mass %: one type or more of the elements selected from the following groups of (i) to (iii), at least including (i), (i) Cr: 14 to 24 mass %, (ii) Nb: 1.5 mass % or less, and Mo: 3.0 mass % or less; and Fe and inevitable impurity as a remainder. The followings are the details of these elements and their content.

1. Each Element and Its Content

<C (Carbon): 0.1 to 0.4 Mass %>

C in the above-stated range serves as an element to stabilize the austenite structure and is effective to improve the high-temperature strength and the castability. When the content is less than 0.1 mass %, such an effect for improvement of the castability is small. When the content exceeds 0.4 mass %, hard particles including Cr carbide crystallize, so that the hardness of the austenite structure increases. This lowers the machinability of the heat-resisting cast steel.

<Si (Silicon): 0.8 to 2.5 Mass %>

Si in the above-stated range is effective to improve the oxidation resistance and the castability. When the content is less than 0.8 mass %, the castability of the heat-resisting cast steel may deteriorate. When the content exceeds 2.5 mass %, the machinability of the heat-resisting cast steel decreases.

<Mn (Manganese): 0.8 to 2.0 Mass %>

Mn in the above-stated range not only stabilizes the austenite structure and but also generates free-cutting particles including MnS in the austenite structure. When the content is less than 0.8 mass %, free-cutting particles including MnS are not generated sufficiently in the austenite structure. In that case, sufficient effect of improving the machinability of the heat-resisting cast steel cannot be expected. Further since deformation-induced martensite may be generated during the processing, the machinability of the austenitic heat-resisting cast steel deteriorates. When the content exceeds 2.0 mass %, irregularities may be generated at the cast due to a reaction with the mold made of silicon oxide ($SiO_2$) during casting. This may lead to surface roughness.

<S (Sulfur): 0.05 to 0.30 Mass %>

S in the above-stated range forms free-cutting particles including MnS, and so the heat-resisting cast steel can have sufficient machinability. When the content is less than 0.05 mass %, free-cutting particles including MnS are not generated sufficiently in the austenite structure. In that case, sufficient effect of improving the machinability of the heat-resisting cast steel cannot be expected. When the content exceeds 0.30 mass %, a great amount of sulfide will be generated, which shortens the thermal fatigue life.

<Ni (Nickel): 5 to 20 Mass %>

Ni in the above-stated range can stabilize the austenite structure. When the content is less than 5 mass %, the oxidation resistance and the stabilization of austenite structure deteriorate, and so the thermal fatigue life is shortened. When the content exceeds 20 mass %, the castability of the heat-resisting cast steel deteriorates.

<N (nitrogen): 0.3 mass % or less>

N in the above-stated range is effective to improve the high-temperature strength, stabilize the austenite phase and create a finer structure. When the content exceeds 0.3 mass %, the yield decreases extremely, which may be a factor of gas defects. To obtain the above-stated effects the content is preferably 0.05 mass % or more, and more preferably 0.09 mass % or more.

<Zr (Zirconium): 0.01 to 0.20 Mass %>

Zr in the above-stated range can yield finer austenite crystal grains, disperse Cr (chrome) segregated at the crystal grain boundary, and stabilize the austenite structure. Finer crystal grains leads to the dispersion of finer MnS in the austenite structure, and so the machinability can be improved.

When the content is less than 0.01 mass %, the effect of improving the machinability due to finer austenite crystal grains cannot be expected. When the content exceeds 0.20 mass %, excessive fine austenite crystal grains may degrade the high-temperature strength. Zr oxide may be mixed in the casting as slag, and the quality of the casting may deteriorate.

<Ce (Cerium): 0.01 to 0.10 Mass %>

Ce in the above-stated range generates free-cutting particles including CeS in the austenite structure. When the content is less than 0.01 mass %, free-cutting particles including CeS are not generated sufficiently in the austenite structure. In that case, sufficient effect of improving the machinability of the heat-resisting cast steel cannot be expected. When the content exceeds 0.10 mass %, Ce oxide may be mixed in the casting as oxide-based inclusion, and the quality of the casting may deteriorate.

Cr, Nb and Mo described below are carbide-forming elements that form carbide in the austenite structure, and the austenitic heat-resisting cast steel contains at least Cr in the below-described range. Although the austenitic heat-resisting cast steel do not necessarily contain Nb and Mo, the austenitic heat-resisting cast steel, which contains any one of these elements in the below-described range, can have improved high-temperature strength and high-temperature proof stress. Particularly the austenitic heat-resisting cast steel, which contains Nb in the below-described range, can have improved creep strength as well, as compared with one containing Mo. The following describes functions of the elements of Cr, Nb and Mo.

<(i) Cr (Chromium): 14 to 24 Mass %>

Cr in the above-stated range is effective to increase the oxidation resistance and improve the high-temperature strength, and so is an essential element that the austenitic heat-resisting cast steel should contain. When the content is less than 14 mass %, the effect for oxidation resistance deteriorates. When the content exceeds 24 mass %, hard particles including Cr carbide will crystallize excessively, so that the hardness of the austenite structure increases. This lowers the machinability of the heat-resisting cast steel.

<(ii) Nb (Niobium): 1.5 Mass % or Less>

Nb is an element that the austenitic heat-resisting cast steel preferably contains. When Nb is contained in the above-described range, fine niobium carbide (NbC) is formed in the austenite structure, from which the effect of improving the heat resistance (high-temperature strength, creep strength, thermal fatigue life) can be expected. Particularly Nb added improves the creep strength greatly. When the content exceeds 1.5 mass %, the machinability of the heat-resisting cast steel decreases because of excessive generation of hard particles NbC. To obtain the above-stated effect, the content is preferably 0.01 mass % or more, and more preferably 0.3 mass % or more.

<Mo (Molybdenum): 3.0 Mass % or Less>

Mo is an element that the austenitic heat-resisting cast steel preferably contains. When Mo is contained in the above-described range, precipitation of molybdenum carbide is increased during heating at high temperatures, from which the effect of improving the heat resistance (high-temperature strength, creep strength, thermal fatigue life) can be expected. When the content exceeds 3.0 mass %, the machinability of the heat-resisting cast steel decreases because of excessive generation of hard particles MoC. To obtain the above-stated effect, the content is preferably 0.008 mass % or more, and more preferably 1 mass % or more.

<Other Elements>

The content of P, which is contained as one element of inevitable impurity, is preferably 0.05 mass % or less. When the content exceeds this, thermal degradation easily occurs due to the repeated heating and cooling, and the toughness also deteriorates. The content exceeding this may be a factor of casting cracks.

The austenitic heat-resisting cast steel of the present embodiment contains iron in the above-stated range, and so is excellent in both of the heat resistance and the machinability. Particularly the austenitic heat-resisting cast steel of the present embodiment contains an appropriate amount of Ni, and therefore the austenite structure can be stabilized and the heat resistance of the heat-resisting cast steel (thermal fatigue life) can be improved.

When the Ni is contained in the above-stated range, the amount of C dissolved in the austenite structure decreases typically, and the amount of C binding to Cr increases. As a result, hard particles including metal carbide, such as Cr carbide, are easily generated. The present embodiment specifies the amount of C, Cr, Nb and Mo so as to limit the amount of generation of these hard particles, and the heat-resisting cast steel contains Mn, S, Zr and Ce in the above-described range of not impairing the heat resistance. Therefore the heat-resisting cast steel of the present embodiment can have improved machinability.

2. Correlation Among the Elements Contributing to Heat Resistance

Based on the content of the elements as described above, correlation among the elements is specified as follows so as to evaluate or estimate the heat resistance of the austenitic heat-resisting cast steel.

In this respect, the present inventors conducted the below-described thermal fatigue test of the austenitic heat-resisting cast steel by distortion control, and focused on certain correlation between the maximum value (maximum stress) umax of the repeated stress acting on the heat-resisting cast steel, and the number of repetitions (thermal fatigue life) Nf when rapture occurred. Specifically during the thermal fatigue test, the thermal fatigue life Nf decreases with an increase in the maximum stress σmax of the austenitic heat-resisting cast steel.

Then, the present inventors focused on C, Ni, Cr, Mo and Nb as the elements affecting the maximum stress max of the austenitic heat-resisting cast steel. Then the present inventors calculated the following expression (1) (regression expression) by multiple regression analysis using the amount of these elements in the austenitic heat-resisting cast steel as parameters so that the maximum stress σmax can be obtained in the thermal fatigue test based on these parameters.

$$P\sigma=399.25+129.78C-1.75Ni-6.23Cr-9.88Mo-26.88Nb \quad (1)$$

Pσ of the left side of Expression (1) represents the parameter (index value) corresponding to the maximum stress σmax. The right side of Expression (1) represents the mathematical expression including the content of C, Ni, Cr, Mo and Nb (mass %) as the parameters, and the value of Pσ corresponding to the maximum stress σmax can be calculated by substituting the values of the content of the elements corresponding to the chemical symbols in this expression. The coefficients of the elements on the right side show the degree of the elements contributing to the maximum stress σmax.

The below-described thermal fatigue test by the present inventors show that the condition of $P\sigma \leq 310$ is preferable, because the maximum stress σmax is 315 MPa or less and the thermal fatigue life exceeds 400 times (cycles) in that case. Therefore the content of C, Ni, Cr, Mo and Nb are specified so as to satisfy the condition of $P\sigma \leq 310$, whereby the thermal fatigue life of the austenitic heat-resisting cast steel can be improved.

3. Correlation Among the Elements Contributing to Machinability

Based on the content of the elements as described above, correlation among the elements is specified as follows so as to evaluate or estimate the machinability of the austenitic heat-resisting cast steel.

The present inventors conducted a test on the machinability of the austenitic heat-resisting cast steel, and measured the amount of wear Vb of the cutting tool used in the test. Next, the present inventors categorized the elements affecting the amount of wear Vb of the cutting tool into the group of Ni, Cr, Mo and Nb that are the elements of accelerating the wear of the cutting tool and the group of S, Zr and Ce that are the elements of improving the machinability of the austenitic heat-resisting cast steel. Then the present inventors calculated the following expression (2) (regression expression) by multiple regression analysis using the amount of these elements in the austenitic heat-resisting cast steel as parameters so that the amount of wear Vb can be obtained based on these parameters.

$$Pm=(0.0038Ni+0.119C+0.0014Cr+0.0136Mo+0.0344Nb)-(0.3129S+0.0353Zr+0.2966Ce)-0.04225 \quad (2)$$

Pm of the left side of Expression (2) represents the parameter (index value) corresponding to the amount of wear Vb. The right side of Expression (2) represents the mathematical expression including the content of Ni, C, Cr, Mo, Nb, S, Zr, and Ce (mass %) as the parameters, and Pm (index value) corresponding to the amount of wear Vb can be calculated by substituting the values of the content of the elements corresponding to the chemical symbols in this expression.

Among the coefficients of the elements on the right side, the coefficients of Ni, C, Cr, Mo and Nb show the degree of the elements contributing to an increase in the amount of wear, and the coefficients of S, Zr and Ce show the degree of the elements contributing to a decrease in the amount of wear.

The below-described test on machinability by the present inventors shows that when the amount of wear Vb of the cutting tool is 0.14 mm or less, the machinability is favorable, and the relationship Pm≤0.09 is preferably satisfied in this case. Therefore the content of Ni, C, Cr, Mo, Nb, S, Zr and Ce is specified so as to satisfy Pm≤0.09, whereby the machinability of the austenitic heat-resisting cast steel can be improved.

EXAMPLES

The following describes the present invention specifically, by way of examples and comparative examples.

Examples 1 to 11

In Examples 1 to 11, test pieces made of the austenitic heat-resisting cast steel (hereinafter called heat-resisting cast steel) were manufactured as follows. Specifically 20 kg of a sample as a starting material of the heat-resisting cast steel having the composition shown in Table 1 and containing Fe (including Fe and inevitable impurity as the remainder) as a base was prepared, which then underwent air dissolution using a high-frequency induction furnace. The thus obtained molten metal was taken out at 1600° C. and then was poured into a sand mold (not preheated) of 25 mm×42 mm×230 mm at 1500 to 1530° C. for solidification, whereby a block piece of the heat-resisting cast steel of JIS Y block B type was obtained. A test piece was cut out from this block piece for each of the tests described below.

The range of the elements of the heat-resisting cast steel according to Examples 1 to 11 was C: 0.1 to 0.4 mass %, Si: 0.8 to 2.5 mass %, Mn: 0.8 to 2.0 mass %, S: 0.05 to 0.30 mass %, Ni: 5 to 20 mass %, N: 0.3 mass % or less. Zr: 0.01 to 0.20 mass %, Ce: 0.01 to 0.10 mass %, one type or more selected from the following groups (i) to (iii), at least including (i), (i) Cr: 14 to 24 mass %, Nb: 1.5 mass % or less, and (iii) Mo: 3.0 mass % or less, and Fe and inevitable impurity as the remainder.

The heat-resisting cast steel of Example 2 included Nb added instead of Mo in Example 1 so as to generate NbC and so increase the heat resistance, and included more Ce so as to increase CeS and so avoid the deterioration of the machinability of the casting steel due to the generation of NbC.

The heat-resisting cast steel of Example 3 included more Ce than Example 1 so as to increase CeS and so had sufficient machinability.

The heat-resisting cast steel of Example 4 included Nb added instead of Mo in Example 1 so as to generate NbC and so have sufficient heat resistance, and included more Ce so as to increase CeS and so had sufficient machinability.

The heat-resisting cast steel of Example 5 included less Ni and less Cr but included more Mo than in Example 1 and Nb added, and so had sufficient heat resistance. This heat-resisting cast steel included less Cr carbide so as to decrease Cr carbide ($Cr_7C_3$, $Cr_{23}C_6$) and had sufficient machinability.

The heat-resisting cast steel of Example 6 included less Ni and less Cr, but included more Si than in Example 1, and so had sufficient heat resistance (oxidation resistance), This heat-resisting cast steel included less Cr carbide so as to decrease Cr carbide ($Cr_7C_3$, $Cr_{23}C_6$) and had sufficient machinability.

The heat-resisting cast steel of Examples 7 to 9 included less Ni as the element of stabilizing austenite and more Mn as an element that is not expensive and can stabilize austenite than in Example 1, and so had stabilized austenite and had sufficient heat resistance.

Particularly, the heat-resisting cast steel of Examples 7 to 9 included less Ni and less Cr than in Example 1 but included Nb added, and so had sufficient heat resistance. This heat-resisting cast steel included less Cr carbide so as to decrease Cr carbide ($Cr_7C_3$, $Cr_{23}C_6$) and had sufficient machinability.

The heat-resisting cast steel of Example 10 included more C than in Example 1 and included Nb added, and so had sufficient heat resistance, and included more Mn and more Zr and Ce, and so had sufficient machinability equal to that of Example 1.

The heat-resisting cast steel of Example 11 included less Ni as the element of stabilizing austenite and, instead, more Mn as an element that is not expensive and can stabilize austenite than in Example 1, and so had stabilized austenite and accordingly had sufficient heat resistance. This heat-resisting cast steel included less Cr carbide so as to decrease Cr carbide (Cr—$C_3$, $Cr_{23}C_6$) and had sufficient machinability.

Comparative Examples 1 to 13

Similarly to Example 1, test pieces made of heat-resisting cast steel were manufactured. Specifically the test pieces were prepared by casting using samples having the components as in Table 1, and the test pieces having the same shape as that of Example 1 were cut out. Note here that these Comparative Examples 1 to 13 included some of the elements of the present invention that were contained beyond the range of the content of the present invention as described below. The elements Nb and Mo should be added selectively in the present invention as described above.

The heat-resisting cast steel of Comparative Example 1 did not include Zr and Ce.

The heat-resisting cast steel of Comparative Example 2 did not include Ce, and included more Zr than in the range of the present invention.

The heat-resisting cast steel of Comparative Example 3 did not include Zr and Ce, and included less S than in the range of the present invention.

The heat-resisting cast steel of Comparative Examples 4, 5 included more Cr than in the range of the present invention.

The heat-resisting cast steel of Comparative Example 6 did not include Zr and Ce, included more C and Cr than in the range of the present invention, and included less Mn and S than in the range of the present invention.

The heat-resisting cast steel of Comparative Example 7 did not include Zr and Ce, included more Ni and Cr than in the range of the present invention, and included less S than in the range of the present invention.

The heat-resisting cast steel of Comparative Example 8 did not include Zr and Ce, included more Ni and Cr than in the range of the present invention, and included less Mn and S than in the range of the present invention. Since this heat-resisting cast steel included more Ni than in the range of the present invention, shrinkage during solidification may be impaired.

The heat-resisting cast steel of Comparative Example 9 did not include N, Zr and Ce, included more Cr than in the range of the present invention, and included less Mn and S than in the range of the present invention.

The heat-resisting cast steel of Comparative Example 10 did not include N and Ce, included more Cr than in the range of the present invention, and included less Mn and S than in the range of the present invention.

The heat-resisting cast steel of Comparative Example 11 did not include Zr and Ce, included more Ni and Cr than in the range of the present invention, and included less Mn and S than in the range of the present invention.

The heat-resisting cast steel of Comparative Example 12 did not include Ce, included more Ni and Cr than in the range of the present invention, and included less Mn and S than in the range of the present invention.

The heat-resisting cast steel of Comparative Example 13 did not include Ce, and included more Cr than in the range of the present invention.

TABLE 1

| | Content of the elements | | | | | | | | | | | | | $Cr_7C_3$ + $Cr_{23}C_6$ | NbC |
|---|---|---|---|---|---|---|---|---|---|---|---|---|---|---|---|
| | Ni | C | Mn | N | Cr | Si | S | Mo | Nb | Zr | Ce | Pσ | Pm | (Mass %) | (Mass %) |
| Ex. 1 | 17.0 | 0.31 | 1.08 | 0.09 | 21.4 | 0.95 | 0.09 | 0.008 | — | 0.06 | 0.011 | 276.3 | 0.056 | 0.0169 | |
| Ex. 2 | 17.2 | 0.30 | 1.00 | 0.15 | 21.8 | 1.00 | 0.10 | — | 1.00 | 0.10 | 0.030 | 245.4 | 0.080 | 0.0118 | 0.0107 |
| Ex. 3 | 16.8 | 0.30 | 1.00 | 0.15 | 19.4 | 1.00 | 0.10 | — | — | 0.10 | 0.050 | 287.9 | 0.035 | 0.0155 | |
| Ex. 4 | 17.0 | 0.30 | 1.00 | 0.15 | 21.6 | 1.00 | 0.10 | — | 1.00 | 0.10 | 0.050 | 247.0 | 0.073 | | |
| Ex. 5 | 15.0 | 0.30 | 1.00 | 0.10 | 17.6 | 1.50 | 0.10 | 2.000 | 0.50 | 0.10 | 0.050 | 269.1 | 0.070 | 0.0134 | 0.0056 |
| Ex. 6 | 12.8 | 0.32 | 0.99 | 0.14 | 18.3 | 1.92 | 0.12 | — | — | 0.01 | 0.010 | 304.4 | 0.030 | | |
| Ex. 7 | 8.0 | 0.33 | 1.46 | 0.18 | 18.8 | 1.34 | 0.09 | 0.008 | 0.51 | 0.09 | 0.050 | 297.2 | 0.026 | | |
| Ex. 8 | 8.1 | 0.34 | 1.42 | 0.19 | 19.4 | 1.28 | 0.09 | — | 1.00 | 0.01 | 0.010 | 281.5 | 0.059 | | |
| Ex. 9 | 8.1 | 0.32 | 1.46 | 0.19 | 19.2 | 1.35 | 0.10 | — | 1.01 | 0.14 | 0.050 | 279.8 | 0.037 | | |
| Ex. 10 | 17.5 | 0.40 | 1.35 | 0.15 | 23.0 | 1.00 | 0.10 | 0.008 | 1.00 | 0.10 | 0.050 | 250.3 | 0.089 | | |
| Ex. 11 | 8.1 | 0.35 | 1.52 | 0.16 | 17.0 | 1.49 | 0.11 | 0.01 | 0.54 | 0.1 | 0.03 | 310 | 0.026 | | |
| Comp. Ex. 1 | 8.1 | 0.33 | 1.41 | 0.15 | 18.8 | 1.75 | 0.11 | — | — | — | — | 310.8 | 0.020 | | |
| Comp. Ex. 2 | 8.1 | 0.31 | 1.48 | 0.10 | 18.4 | 1.84 | 0.11 | — | — | 0.35 | — | 310.7 | 0.004 | | |
| Comp. Ex. 3 | 17.1 | 0.33 | 1.04 | 0.06 | 22.3 | 0.90 | 0.01 | 0.009 | 0.01 | — | — | 272.9 | 0.091 | 0.0164 | |
| Comp. Ex. 4 | 19.9 | 0.33 | 1.08 | 0.08 | 24.8 | 2.02 | 0.10 | — | 1.02 | 0.07 | 0.018 | 225.3 | 0.103 | 0.0109 | 0.0101 |
| Comp. Ex. 5 | 19.9 | 0.33 | 1.06 | 0.09 | 25.8 | 1.96 | 0.10 | — | 1.02 | 0.07 | 0.020 | 219.1 | 0.104 | 0.0110 | 0.0101 |
| Comp. Ex. 6 | 19.9 | 0.45 | 0.73 | 0.07 | 24.9 | 1.42 | 0.01 | — | — | — | — | 267.7 | 0.119 | 0.0288 | |
| Comp. Ex. 7 | 20.1 | 0.33 | 1.08 | 0.08 | 25.0 | 1.36 | 0.01 | 0.009 | 0.01 | — | — | 250.8 | 0.106 | 0.0203 | |
| Comp. Ex. 8 | 24.9 | 0.33 | 0.29 | 0.10 | 24.8 | 1.88 | 0.01 | — | 0.50 | — | — | 230.6 | 0.140 | 0.0169 | 0.0043 |
| Comp. Ex. 9 | 18.9 | 0.34 | 0.28 | — | 24.9 | 2.02 | 0.01 | — | 0.49 | — | — | 242.0 | 0.119 | | |
| Comp. Ex. 10 | 19.8 | 0.34 | 0.29 | — | 24.9 | 2.07 | 0.01 | — | 0.49 | 0.19 | — | 240.4 | 0.115 | | |
| Comp. Ex. 11 | 20.2 | 0.35 | 0.32 | 0.11 | 25.0 | 1.82 | 0.01 | — | 1.04 | — | — | 225.6 | 0.144 | | |
| Comp. Ex. 12 | 21.8 | 0.35 | 0.32 | 0.08 | 24.8 | 1.90 | 0.01 | — | 1.54 | 0.17 | — | 210.6 | 0.161 | | |
| Comp. Ex. 13 | 10.2 | 0.34 | 1.09 | 0.12 | 25.0 | 1.82 | 0.10 | 0.007 | — | 0.08 | — | 254.0 | 0.072 | | |

<Measurement of the Amount of Elements>

The content of carbon and sulfur in the heat-resisting cast steel shown in Table 1 were measured using a high-frequency combustion-infrared based carbon/sulfur analyzer (produced by Horiba, Ltd. EMIA-3200). Specifically a sample was prepared, containing tungsten combustion improver (chip-form, the rate of carbon content: 0.01% or less), magnesium perchlorate (anhydrous, grain size: 0.7 to 1.2 mm) and Ascharite. This sample and the heat-resisting cast steel as stated above were molten under the oxygen (dry oxygen having purity of 99.999% or more) atmosphere in a high-frequency crucible (ceramic crucible) for measurement. The dust filter used was fiberglass.

The content of nitrogen in the heat-resisting cast steel shown in Table 1 was measured using an oxygen/nitrogen analyzer (produced by LECO, type TC-436). Specifically a sample made of Anhydrone (magnesium perchlorate), Ascharite (carbon dioxide absorber), copper oxide (granulated) and metallic copper (ribbon-form) was prepared. This sample and the heat-resisting cast steel as stated above were molten under the mixed gas atmosphere containing the mixture of helium (less than 99.99 mass %) and argon (less than 99.99 mass %) in a graphite crucible for measurement of nitrogen. The dust filter used was fiberglass.

The content of silicon in the heat-resisting cast steel shown in Table 1 was measured by a silicon dioxide gravimetric method. Specifically a sample made of the austenitic heat-resisting cast steel as stated above was decomposed with aqua regia, to which perchloric acid was added for evaporation by heating, to form insoluble silicon dioxide from the silicon. After filtration, the resultant underwent ignition for constant mass. Next, hydrofluoric acid was added for vaporization and volatilization of the silicon dioxide, and the amount of silicon was determined from the decrease amount. The content of other elements in the heat-resisting cast steel shown in Table 1 was measured by a typical IPC emission spectrometry.

<Thermal Fatigue Test>

Thermal fatigue test was conducted for the test pieces of heat-resisting cast steel according to Examples 1 to 11 and Comparative Examples 1 to 13 using a hydraulic thermal fatigue tester (Servopulser produced by Shimadzu Corporation) and a high-frequency coil having cooling function. For these test pieces, a dumbbell-like solid round bar (n=1)

having a parallel part of 10 mm in diameter and 20 mm in length was cut out from the Y block of B type as stated above.

Figure 9A:
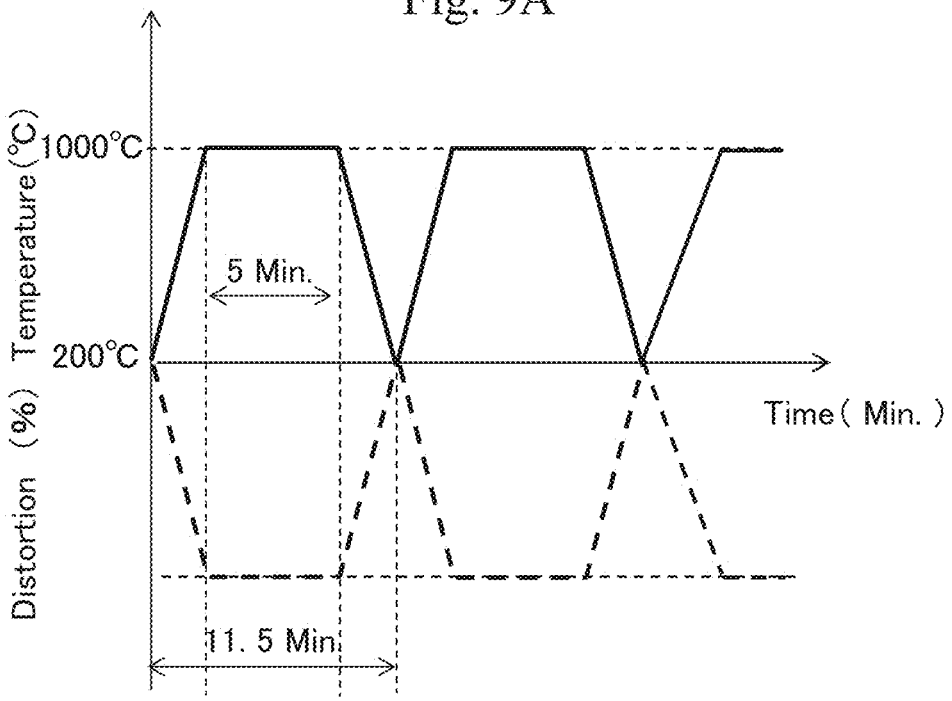
FIG. 9A explains the temperature control and distortion control conducted for the austenitic heat-resisting cast steel in the thermal fatigue test.

As shown in FIG. 9A, repeated test was conducted, in which the heating temperature of the test pieces was controlled to have a temperature profile in a trapezoidal waveform between 200 to 1000° C. (11 min. for one cycle). The test pieces were constrained under the 50% constraint condition, and the distortion was controlled so as to be out of phase. The 50% constraint condition refers to the state where the test piece is constrained with the amount that is 50% of the distortion of thermal expansion ΔL when the test piece is heated. The distortion toward compression is controlled so as to increase with an increase in temperature.

Figure 9B:
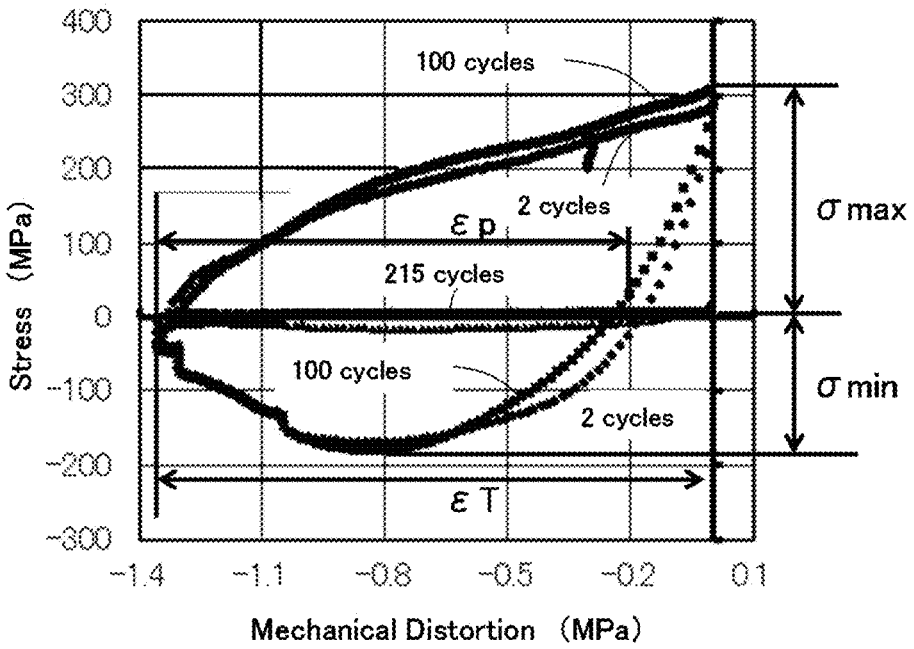
FIG. 9B shows one example of the stress-distortion diagram of the austenitic heat-resisting cast steel obtained in the thermal fatigue test.
Figure 9C:
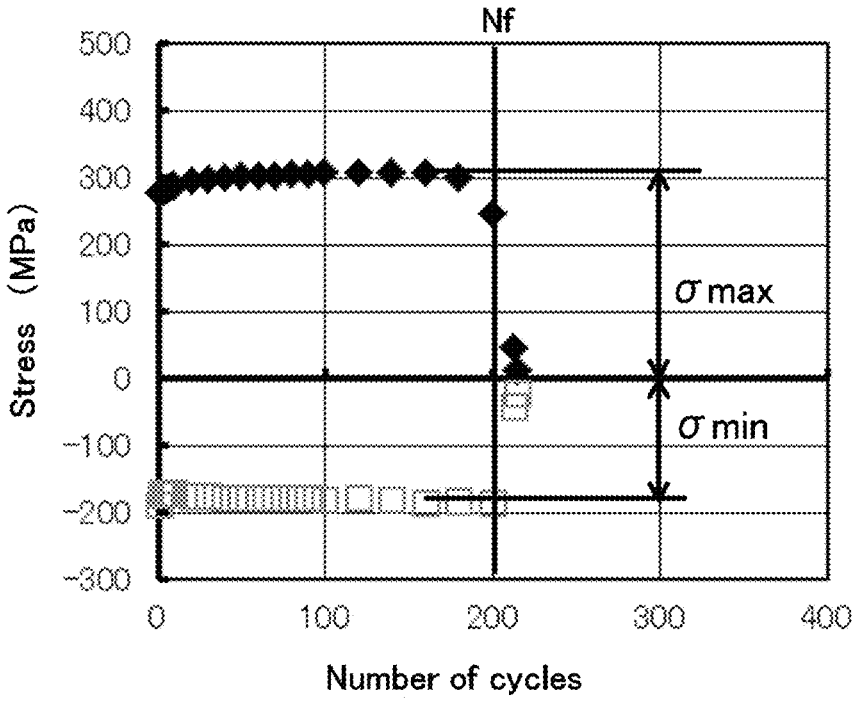
FIG. 9C explains how to calculate the maximum value of the repeated stress and the thermal fatigue life of the austenitic heat-resisting cast steel obtained in the thermal fatigue test.

Thereby, as shown in FIG. 9B, stress-distortion hysteresis loop was obtained for each cycle, and the largest stress among all of the cycles, the maximum value of the repeated stress (maximum stress) σmax was measured. FIG. 9B shows the plastic distortion εp, the total distortion εT, and the minimum value of the repeated stress (minimum stress) min as well. In FIG. 9C, the thermal fatigue life Nf is the number of cycles when the stress decreased by 25% from the maximum stress σmax.

Table 2 shows the measurement result of the maximum stress σmax and the thermal fatigue life Nf of the heat-resisting cast steel according to Examples 1 to 11 and Comparative Examples 1 to 13. FIG. 1 shows the relationship between the maximum value of the repeated stress and the thermal fatigue life of the heat-resisting cast steel according to Examples 1 to 11 and Comparative Examples 1 to 13.

<Machinability Test>

Machinability test was conducted for the test pieces of heat-resisting cast steel according to Examples 1 to 10 and Comparative Examples 1 to 8 and 13. For these test pieces, a round bar (n=1) of 66 mm in diameter and 190 mm in length was cut out from the Y block of B type as stated above.

Figure 2:
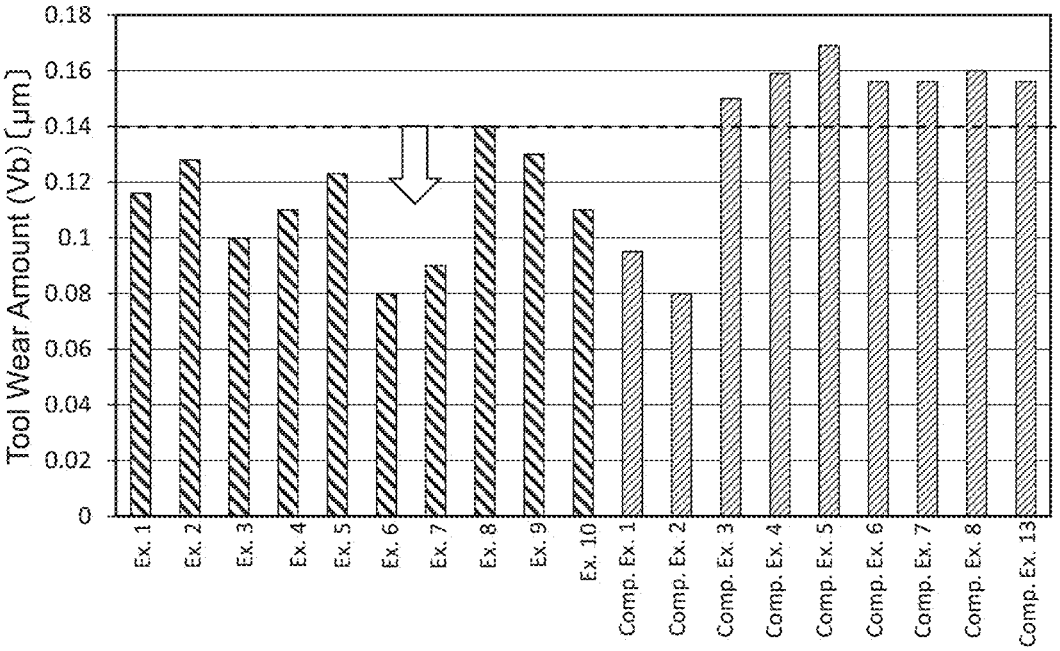
FIG. 2 shows the amount of wear of the cutting tool when the austenitic heat-resisting cast steel according to Examples 1 to 10 and Comparative Examples 1 to 8 and 13 was cut.

The test piece was secured by a clamp on one side, and was supported in a center hole of a rotation jig on the other side. The test piece in this state was turned (cut) by a cutting tool. The circumferential velocity of the test piece for turning was 125 m/min., and the amount of wear Vb of the cutting tool was measured at the flank of the cutting tool after the turning of 2 km. Table 2 and FIG. 2 show the amount of wear Vb of the cutting tool for the test pieces of the heat-resisting cast steel according to Examples 1 to 10 and Comparative Examples 1 to 8 and 13.

<Amount of Generation of $Cr_7C_3$ and Nb>

Figure 3:
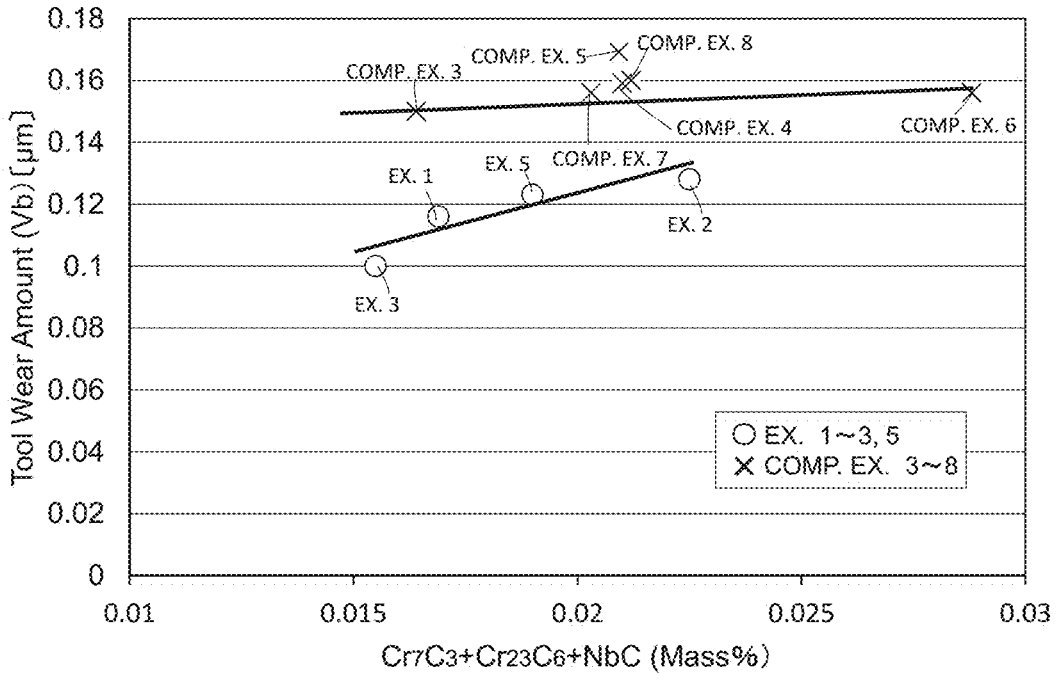
FIG. 3 shows the relationship between the amount of carbide and the amount of wear of the cutting tool for the austenitic heat-resisting cast steel according to Examples 1 to 3, 5 and Comparative Examples 3 to 8.

The amount of generated $Cr_7C_3$, $Cr_{23}C_6$ and NbC in the heat-resisting cast steel was calculated through an analysis using an equilibrium diagram based on the amount of elements added in the heat-resisting cast steel according to Examples 1 to 3, Example 5 and Comparative Examples 3 to 8. The analysis was made using commercially available integrated thermodynamic calculation software (Thermo-Calc.) produced by Thermo-Calc Software Inc. Table 1 shows the result. FIG. 3 shows the relationship among the amount of wear of cutting tool and the total amount (amount of carbide) of the mount of generated $Cr_7C_3$. $Cr_{23}C_6$ and the amount of generated NbC.

TABLE 2

| | Machinability Vb(mm) | Thermal Fatigue Property σ max (MPa) | Nf (cycle) |
|---|---|---|---|
| Ex. 1 | 0.116 | 295 | 550 |
| Ex. 2 | 0.128 | 245 | 609 |
| Ex. 3 | 0.100 | 280 | 480 |
| Ex. 4 | 0.110 | 287 | 570 |
| Ex. 5 | 0.123 | 269 | 463 |
| Ex. 6 | 0.080 | 290 | 406 |
| Ex. 7 | 0.090 | 294 | 542 |
| Ex. 8 | 0.140 | 295 | 450 |
| Ex. 9 | 0.130 | 274 | 401 |
| Ex. 10 | 0.110 | 245 | 900 |
| Ex. 11 | — | 315 | 422 |
| Comp. Ex. 1 | 0.095 | 301 | 350 |
| Comp. Ex. 2 | 0.080 | 308 | 330 |
| Comp. Ex. 3 | 0.150 | 271 | 558 |
| Comp. Ex. 4 | 0.159 | 204 | 1189 |
| Comp. Ex. 5 | 0.169 | 204 | 1180 |
| Comp. Ex. 6 | 0.156 | 276 | 700 |
| Comp. Ex. 7 | 0.156 | 276 | 700 |
| Comp. Ex. 8 | 0.160 | 217 | 1274 |
| Comp. Ex. 9 | — | 249 | 1001 |
| Comp. Ex. 10 | — | 231 | 891 |
| Comp. Ex. 11 | — | 226 | 1206 |
| Comp. Ex. 12 | — | 211 | 1354 |
| Comp. Ex. 13 | 0.156 | 248 | 690 |

<Result 1>

As shown in FIG. 1, the heat-resisting cast steel according to Examples 1 to 11 and Comparative Examples 3 to 13 had the thermal fatigue life of 400 cycles or more, whereas the heat-resisting cast steel according to Comparative Examples 1, 2 had the thermal fatigue life of less than 400 cycles. As shown in FIG. 2, the amount of wear of the cutting tool for the heat-resisting cast steel according to Examples 1 to 10 was smaller than that of Comparative Examples 3 to 8 and Comparative Example 13. The machinability test was not conducted for the heat-resisting cast steel according to Comparative Examples 9 to 12. Since the heat-resisting cast steel according to Comparative Examples 9 to 12 had more Cr than in Examples 1 to 11 (exceeding 24 mass %), hard particles including Cr carbide were easily generated. In addition, the heat-resisting cast steel according to Comparative Examples 9 to 12 had less S as a free-cutting element than in Examples 1 to 11, and did not include Ce. Therefore the heat-resisting cast steel according to these Comparative Examples had obviously lower machinability than in Examples 1 to 11.

Since the heat-resisting cast steel according to Comparative Examples 3 to 8 included less S as a free-cutting element to improve the machinability than in Examples 1 to 11 and did not include Zr and Ce, the amount of wear of the cutting tool was more than that in Examples 1 to 3 and 5 as shown in FIG. 3. For Comparative Example 4, Cr was the only element contained beyond the range of the present invention. Considering the balance with the other elements, however, the parameter Pm described below was greatly different. The machinability of this Comparative Example presumably was inferior to the others because of such a different parameter.

<Pσ>

As shown in FIG. 1, the maximum value (maximum stress) σmax of the repeated stress acting on the heat-resisting cast steel according to Examples 1 to 11 and Comparative Examples 1 to 13 and the number of repetitions (thermal fatigue life) Nf when rapture occurred have certain correlation. That is, the thermal fatigue life Nf decreased with an increase in the maximum stress σmax of the heat-resisting cast steel.

Then, the present inventors chose C, Ni, Cr, Mo and Nb as the elements affecting the maximum stress σmax of the heat-resisting cast steel, and studied the interaction among these elements for the maximum stress σmax of the heat-resisting cast steel. Specifically the present inventors calculated the following expression (1) (regression expression) by multiple regression analysis using the amount of these elements in the austenitic heat-resisting cast steel as parameters so that the index value corresponding to the maximum stress σmax can be obtained.

$$P\sigma=399.25+129.78C-1.75Ni-6.23Cr-9.88Mo-26.88Nb \quad (1)$$

Figure 4:
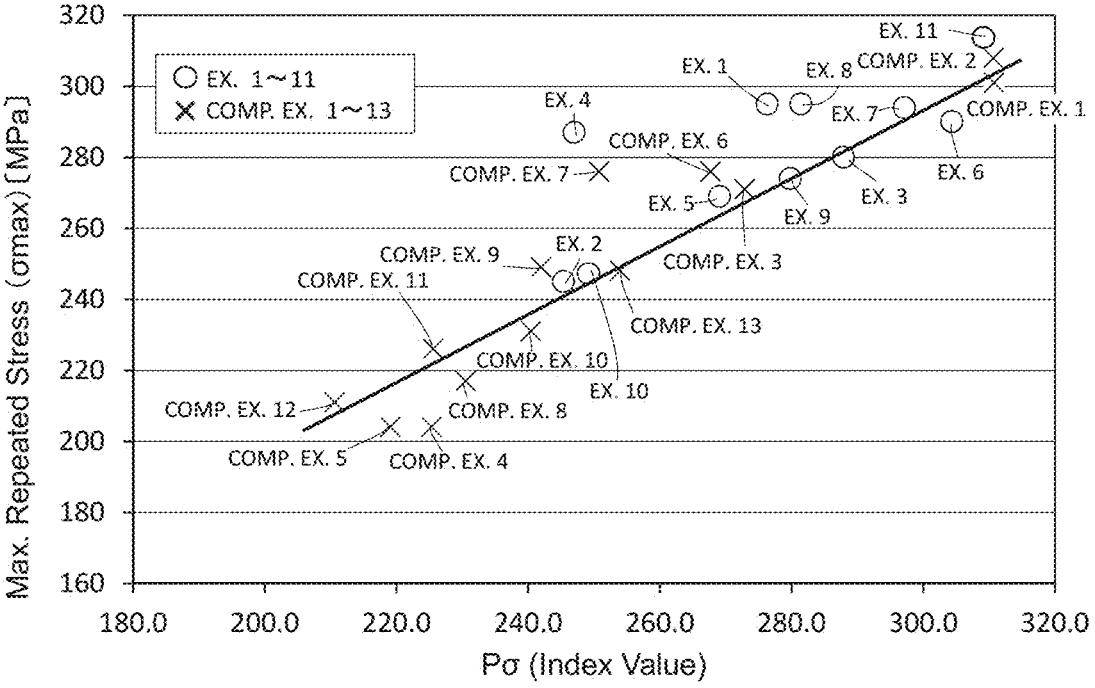
FIG. 4 shows the relationship between parameter PcF and the maximum value of the repeated stress of the austenitic heat-resisting cast steel according to Examples 1 to 11 and Comparative Examples 1 to 13.

From this expression, Pσ of the heat-resisting cast steel according to Examples 1 to 11 and Comparative Examples 1 to 13 was calculated. Table 1 shows the result. FIG. 4 shows the relationship between Pσ of the heat-resisting cast steel according to Examples 1 to 11 and Comparative Examples 1 to 13 and the maximum value aximum stress) σmax of the repeated stress. As is obvious from FIG. 4 as well, PG and the maximum stress σmax have a substantially linear relationship, and so the value corresponding to the maximum stress σmax can be obtained by calculating PG using Expression (1) based on the content of C, Ni, Cr, Mo and Nb.

Figure 5:
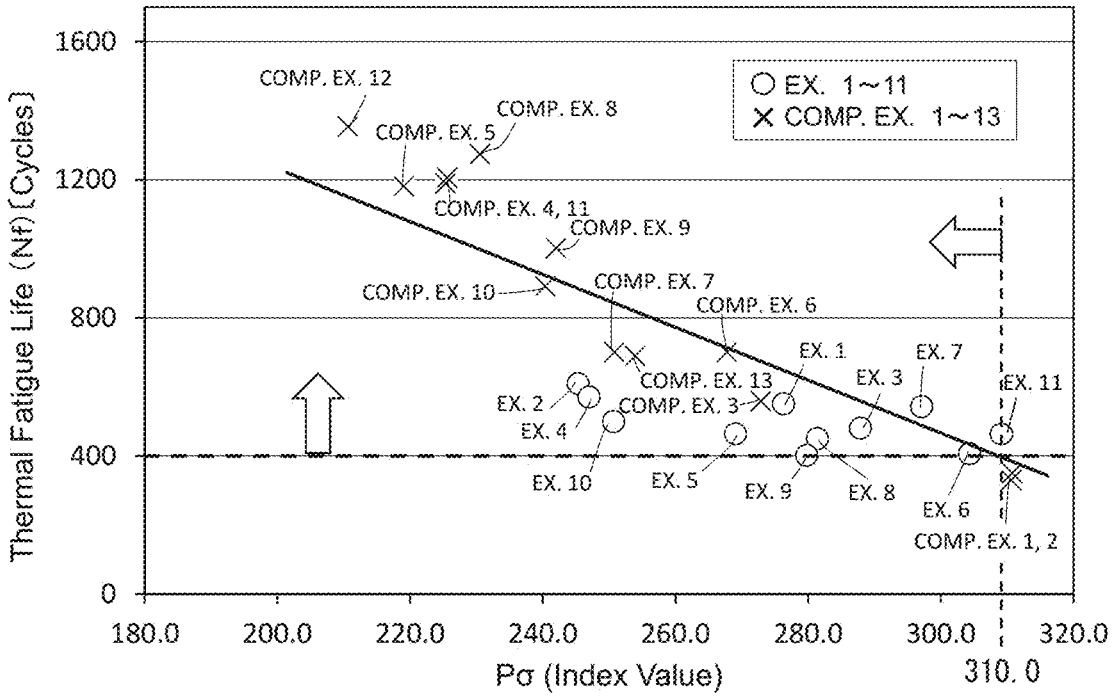
FIG. 5 shows the relationship between parameter Pu and thermal fatigue life of the austenitic heat-resisting cast steel according to Examples 1 to 11 and Comparative Examples 1 to 13.

FIG. 5 shows the relationship between Pσ of the heat-resisting cast steel according to Examples 1 to 11 and Comparative Examples 1 to 13 and the number of repetitions (thermal fatigue life) Nf when rapture occurred. As shown in FIG. 5, Examples 1 to 11 satisfying Pσ≤310 improved the thermal fatigue life Nf reliably. Since Comparative Examples 3 to 13 also satisfied Pσ≤310, their thermal fatigue life Nf was improved. However, any one of the elements included in these Comparative Examples was beyond the range of the present invention, and so these Comparative Examples were inferior in the characteristics other than thermal fatigue life. In this way, at least the thermal fatigue life can be evaluated or estimated based on the value of Pσ.

<Pm>

Next, the present inventors categorized the elements affecting the amount of wear Vb of the cutting tool into the group of Ni, C, Cr, Mo and Nb that are the elements of accelerating the wear of the cutting tool and the group of S, Zr and Ce that are the elements of improving the machinability. Then the present inventors calculated the following expression (2) (regression expression) by multiple regression analysis using the amount of these elements in the heat-resisting cast steel as parameters so that the amount of wear Vb of the cutting tool according to Examples 1 to 10 and Comparative Examples 1 to 8 and 13 can be obtained based on these parameters.

$$Pm=(0.0038Ni+0.119C+0.0014Cr+0.0136Mo+0.0344Nb)-(0.3129S+0.0353Zr+0.2966Ce)-0.04225 \quad (2)$$

Figure 6:
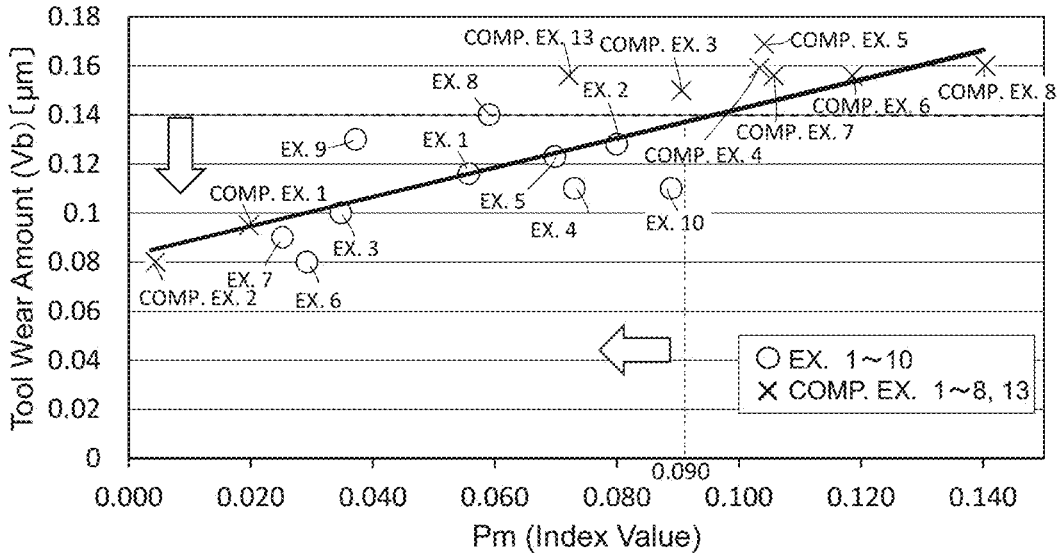
FIG. 6 shows the relationship between parameter Pm and the amount of wear of the cutting tool for the austenitic heat-resisting cast steel according to Examples 1 to 10 and Comparative Examples 1 to 8 and 13.

From this expression, Pm of the heat-resisting cast steel according to Examples 1 to 10 and Comparative Examples 1 to 8 and 13 was calculated. Table 1 and FIG. 6 show the result. FIG. 6 shows the relationship between Pm of the heat-resisting cast steel according to Examples 1 to 10 and Comparative Examples 1 to 8 and 13 and the amount of wear of the cutting tool. When the amount of wear Vb of the cutting tool is 0.14 mm or less, the machinability is favorable, and the relationship Pm≤0.09 is preferably satisfied in this case. Therefore the content of Ni, C, Cr, Mo, Nb, S, Cr and Ce are specified so as to satisfy Pm≤0.09, hereby the machinability of the heat-resisting cast steel can be improved.

Although Comparative Example 13 satisfied Pm≤0.09, the content of the elements, such as Cr and Ce, was beyond the range as stated above (the range of the present invention). As a result, the amount of wear Vb of the cutting tool was more than that in Examples 1 to 10.

Since Comparative Examples 1, 2 also satisfied Pm≤0.09, their machinability (amount of wear Vb of the tool) was improved. However, any one of the elements included in these Comparative Examples was beyond the range of the present invention, and so these Comparative Examples were inferior in the characteristics other than machinability. In this way, at least the machinability can be evaluated or estimated based on the value of Pm.

<Creep Test>

Figure 7:
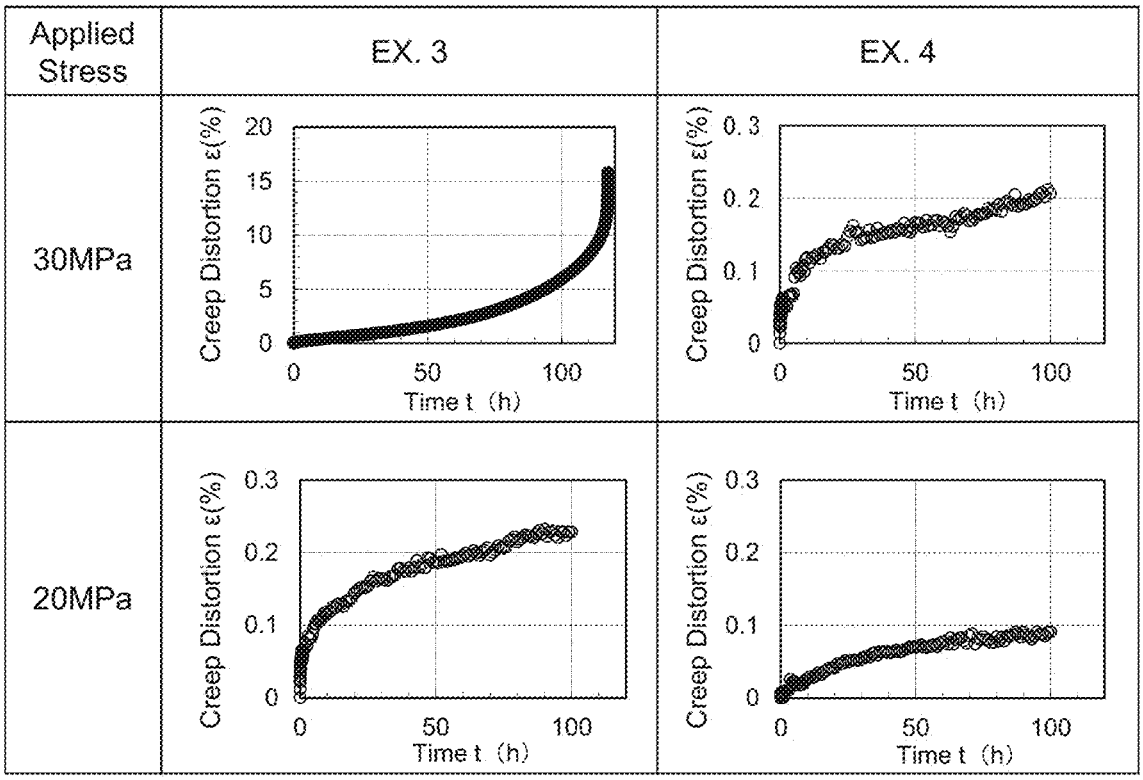
FIG. 7 shows the result of creep test for the austenitic heat-resisting cast steel according to Examples 3 and 4.

Creep test was conducted for the test pieces of heat-resisting cast steel according to Examples 3 and 4. For these test pieces, a dumbbell-like solid round bar having a parallel part of 6 mm in diameter and 30 mm in length was cut out from the JIS Y block of B type as stated above. Then, their creep distortion was measured while applying tensile stress at both ends of the test piece in the high-temperature atmosphere at 1000° C., and the relationship between the time and the creep distortion (creep rate) was found. Two levels of the stress was applied, including 20 MPa and 30 MPa. Table 3 and FIG. 7 show the result.

TABLE 3

| | Creep Distortion ε after 100 hr (%) | |
|---|---|---|
| | Stress 30 MPa | Stress 20 MPa |
| Ex. 3 | 6.0% | 0.23% |
| Ex. 4 | 0.21% | 0.09% |

<Result 2>

As compared with Example 3 not including Nb, Example 4 including Nb had smaller creep distortion after holding for 100 hours at 1000° C., i.e., a small creep rate. Both of these Examples had similar characteristics for the thermal fatigue and the machinability as in the test result as stated above, and the creep rate was greatly improved in the example including Nb. In this way, the result of the creep test shows that the heat-resisting cast steel preferably includes Nb as an essential element so as to improve the thermal fatigue as well as the creep rate.

Examples 12 to 15

Similarly to Example 7, test pieces made of heat-resisting cast steel were manufactured. Examples 12 to 15 were different from Example 7 in the content of Zr as shown in Table 4. Each of these test pieces was a dumbbell-like solid round bar having a parallel part of 8 mm in diameter and 124 mm in length, and was cut out from the Y block of B type as stated above.

Comparative Examples 14 to 16

Similarly to Example 7, test pieces made of heat-resisting cast steel were manufactured. Examples 14 to 16 were different from Example 7 in the content of Zr as shown in Table 4.

<High-Temperature Tensile Test>

Figure 8:
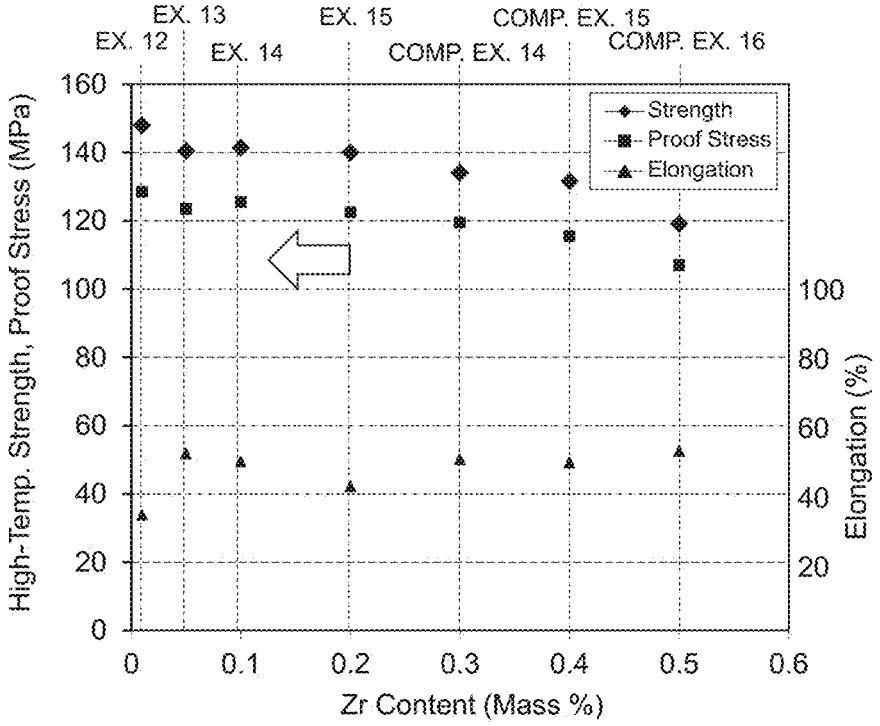
FIG. 8 shows the relationship between the content of Zr of the austenitic heat-resisting cast steel according to Examples 12 to 15 and Comparative Examples 14 to 16 and their high-temperature tensile strength, high-temperature proof stress and elongation.

High-temperature tensile test was conducted for the test pieces (n=2) of the heat-resisting cast steel of Examples 12 to 15 and Comparative Examples 14 to 16. The test was conducted using an autograph and a constant-temperature chamber produced by Shimadzu Corporation, and at the constant temperature of 900° C. and tensile rate of 0.6 mm/min. FIG. 8 and Table 4 show the tensile strength, the proof stress and the elongation of the heat-resisting cast steel of Examples 12 to 15 and Comparative Examples 14 to 16.

TABLE 4

| | Zr Content (Mass %) | Strength (MPa) | Proof Stress (MPa) | Elongation (%) |
|---|---|---|---|---|
| Ex. 12 | 0.01 | 148 | 128.5 | 33.8 |
| Ex. 13 | 0.05 | 140.5 | 123.5 | 51.75 |
| Ex. 14 | 0.10 | 141.5 | 125.5 | 49.45 |
| Ex. 15 | 0.20 | 140 | 122.5 | 42.15 |
| Comp. Ex. 14 | 0.30 | 134 | 119.5 | 50.1 |
| Comp. Ex. 15 | 0.40 | 131.5 | 115.5 | 49.15 |
| Comp. Ex. 16 | 0.50 | 119 | 107 | 52.5 |

<Result 3>

The result shows that when the content of Zr was 0.01 to 0.20 mass % as in Examples 12 to 15, their high-temperature strength (tensile strength, proof stress) was high unlike Comparative Examples 14 to 16. It can be considered that the heat-resisting cast steel according to Examples 12 to 15 included appropriate amount of Zr, and so had finer austenite crystal grains, dispersed Cr (chrome) segregated at the crystal grain boundary, and stabilized the austenite structure. On the contrary, when the content exceeded 0.20 mass % as in the heat-resisting cast steel of Comparative Examples 14 to 16, it can be considered that excessive fine austenite crystal grains degraded the high-temperature strength.

That is a detailed description of the embodiment of the present invention. The present invention is not limited to the above-stated embodiment, and the design may be modified variously without departing from the spirits of the present invention defined in the attached claims.

The invention claimed is:

1. Austenitic heat-resisting cast steel, comprising:

C: 0.1 to 0.4 mass %;

Si: 0.8 to 2.5 mass %;

Mn: 0.8 to 2.0 mass %;

S: 0.05 to 0.30 mass %;

Ni: 5 to 20 mass %;

N: 0.3 mass % or less;

Zr: 0.01 to 0.20 mass %;

Ce: 0.01 to 0.10 mass %;

Cr: 14 to 24 mass %;

one or both of the elements of the following groups (i) or (ii);

(i) Nb: 1.5 mass % or less; or (ii) Mo: 3.0 mass % or less; and

Fe and inevitable impurity as a remainder.

2. The austenitic heat-resisting cast steel according to claim 1, wherein the steel includes the element of group (i).

3. The austenitic heat-resisting cast steel according to claim 1, wherein the steel includes the element of group (ii).

4. The austenitic heat-resisting cast steel according to claim 1, wherein the steel includes the element of group (i) and the element of group (ii).

5. The austenitic heat-resisting cast steel according to claim 1, wherein a value of the parameter Pm in the following expression (1) based on the mass percent of elements in the steel is less than or equal 0.09;

$$Pm=(0.0038Ni+0.119C+0.0014Cr+0.0136Mo+0.0344Nb)-(0.3129S+0.0353Zr+0.2966Ce)-0.04225. \quad \text{Expression (1):}$$

6. The austenitic heat-resisting cast steel according to claim 1, wherein a value of the parameter in Pa in the following expression (2) based on the mass percent of elements in the steel is less than or equal to 310, $$P\sigma=399.25+129.78C-1.75Ni-6.23Cr-9.88Mo-26.88Nb. \quad \text{Expression (2):}$$

7. The austenitic heat-resisting cast steel according to claim 5, wherein a value of the parameter in Pa in the following expression (2) based on the mass percent of elements in the steel is less than or equal to 310, $$P\sigma=399.25+129.78C-1.75Ni-6.23Cr-9.88Mo-26.88Nb. \quad \text{Expression (2):}$$

8. The austenitic heat-resisting cast steel according to claim 1, wherein a content of C is greater than a content of S.

9. The austenitic heat-resisting cast steel according to claim 1, wherein C is 0.3 to 0.4 mass %.

* * * * *